United States Patent [19]

Lathion et al.

[11] Patent Number: 5,000,677

[45] Date of Patent: Mar. 19, 1991

[54] ATOMIZING BURNER FOR LIQUID FUELS

[75] Inventors: Jean Lathion, St. Leonhard; Charles Grivet, Bramois, both of Switzerland

[73] Assignee: R+ D Carbon Ltd., Sierre, Switzerland

[21] Appl. No.: 387,851

[22] Filed: Jul. 31, 1989

[30] Foreign Application Priority Data

Aug. 4, 1988 [CH] Switzerland ..... 02952/88

[51] Int. Cl.[5] ..... F23C 5/08; B05B 7/00

[52] U.S. Cl. ..... 431/187; 431/354; 239/407; 239/412; 239/418

[58] Field of Search ..... 431/187, 188, 354, 89, 431/90; 239/407, 412, 419.3, 419.5

[56] References Cited

U.S. PATENT DOCUMENTS

| | | | |
|---|---|---|---|
| 399,864 | 3/1889 | Fisk | 431/187 |
| 1,381,144 | 6/1921 | Vallely | 431/354 |
| 1,512,132 | 10/1924 | Pfahl | 431/187 X |
| 2,239,025 | 4/1941 | Vigneault | 431/187 X |
| 3,377,024 | 4/1968 | Nutten et al. | 431/187 X |
| 3,386,315 | 9/1974 | Shular | 431/188 X |

FOREIGN PATENT DOCUMENTS

| | | | |
|---|---|---|---|
| 172755 | 12/1921 | United Kingdom | 431/187 |

*Primary Examiner*—Carl D. Price

*Attorney, Agent, or Firm*—Bachman & LaPointe

[57] ABSTRACT

An atomizing burner with a nozzle tube having a mouth opening edge, for feeding liquid fuel to a firing chamber, is to be improved in that, for the purposes of combustion of heavy oil the nozzle tube 33 is surrounded by a jacket tube (14) which projects beyond the mouth opening edge (34) of the nozzle tube and with same forms an annular space (50) for secondary air (z) which can be supplied to the heavy oil downstream of a primary air flow (y) in the flow direction. In addition the jacket tube (14) is to be provided with lateral openings (51) for the secondary air (Z) to be introduced into the annular space (50).

2 Claims, 1 Drawing Sheet

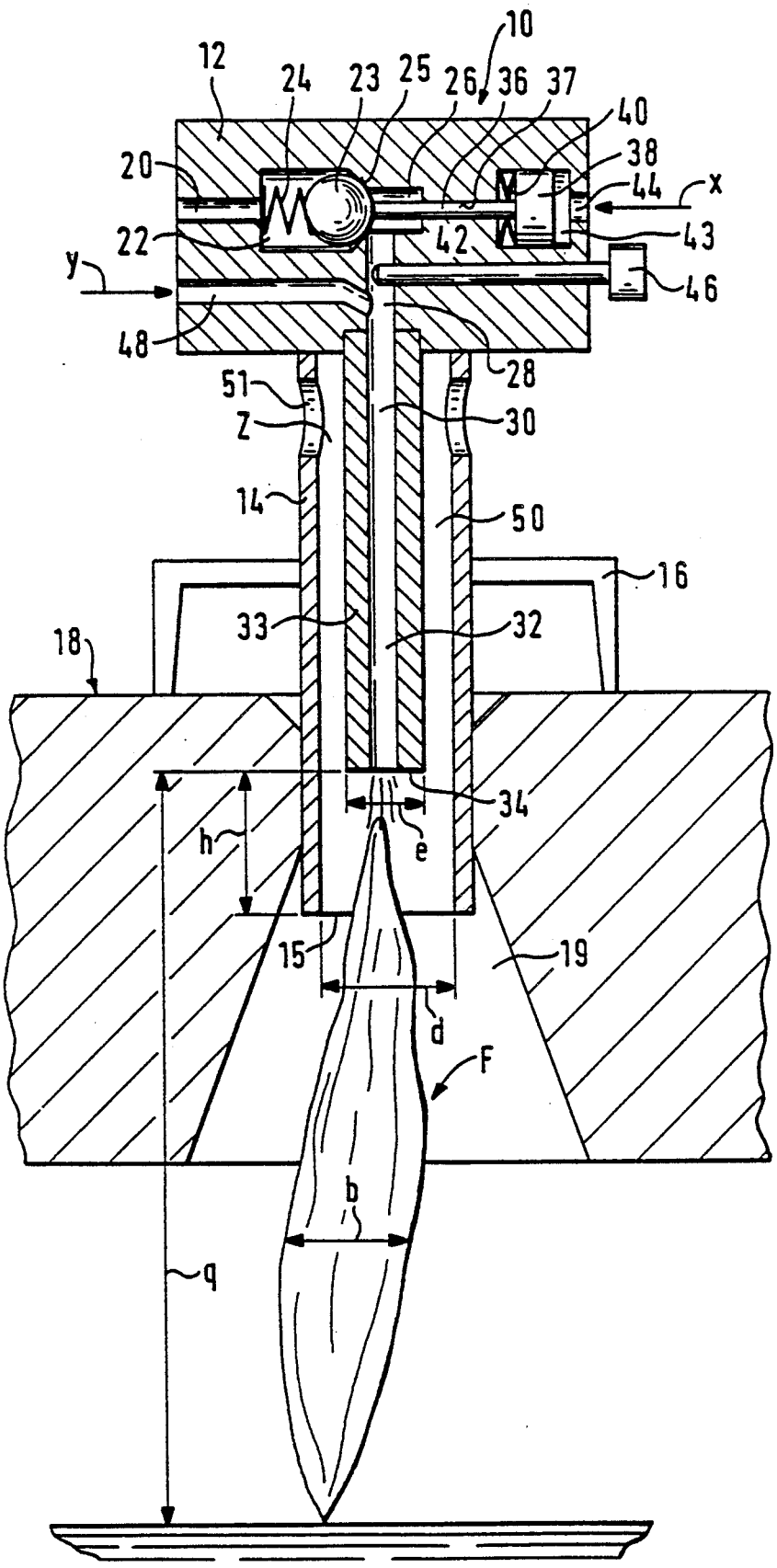
10
12
24
23
25
26
36
37
40
38
20
44
x
22
42
43
y
46
48
28
51
Z
30
14
50
16
33
32
18
34
h
e
15
19
d
F
b
q

ATOMIZING BURNER FOR LIQUID FUELS

BACKGROUND OF THE INVENTION

The invention relates to an atomizing burner comprising a nozzle tube having a mouth opening edge, for the feed of liquid fuel to a firing chamber.

Firing installations for liquid fuels usually include pressure atomizers, rotary atomizers, injection atomizers or swirl devices of various kinds.

In regard to using heavy oil which includes impurities such as sand, fibers or the like, atomizing burners of conventional kind are comparatively susceptible to trouble because of those impurities and hitherto it has not been possible to use fine nozzles.

In addition, in a start/stop mode of operation, there is the danger of heavy oil residues coking up.

Having regard to those considerations, the inventor set himself the aim of providing a novel atomizing burner for heavy oil, which on the one hand affords a comparatively small cross-section and which on the other hand avoids the above-indicated dangers.

SUMMARY OF THE INVENTION

That problem is solved in that the heavy oil is mixed with air and then burnt. In that procedure according to the invention, in the event of an interruption, the air flow is maintained and continues to clean and cool the apparatus.

The atomizing burner according to the invention is distinguished in that, for the purposes of combustion of heavy oil the nozzle tube is surrounded by a jacket tube which projects beyond the mouth opening edge of the nozzle tube and with same forms an annular space for secondary air which can be supplied to the heavy oil downstream of a primary air flow in the flow direction. In accordance with the invention the jacket tube is provided with lateral openings for the secondary air to be introduced into the annular space.

Although it is known for example to burn dust/air mixtures, hitherto however heavy oil has not been burnt in the above-described manner.

The diameter of the nozzle tube according to the invention for heavy oil is selected to be between 8 to 20 mm, preferably being about 16 mm. The diameter of the jacket tube, according to the invention, measures from 40 to 100 mm, preferably about 60 mm.

The distance by which the jacket tube projects beyond the mouth opening edge of the nozzle tube is about 10 times the diameter of the nozzle tube and is preferably 150 mm, with a possible length range of between 100 and 200 mm.

It will be clear here that comparatively narrow nozzles can also be employed for use in burning heavy oil.

According to the invention, the nozzle tube is connected, with the jacket tube, at one end, to a housing block which includes at least one valve for the heavy oil, in particular a valve in the form of a valve member which is disposed in a valve chamber and which is to be guided at a spacing relative to its valve seat by means of the pushrod of a piston; the piston forms a servo control arrangement with its pushrod, for it can be acted upon by compressed air and is comparatively sensitive.

Preferably in the region of the housing block and downstream of the above-described valve the atomizing burner according to the invention includes a metering regulator which varies the cross-section and/or at least one air supply passage for the primary air.

BRIEF DESCRIPTION OF THE DRAWINGS

Further advantages, features and details of the invention will be apparent from the following description of a preferred embodiment and with reference to the drawing.

The drawing is a cross-sectional view of the atomizing burner of the present invention.

DETAILED DESCRIPTION

The drawing is a diagrammatic view in cross-section through an atomizing burner 10 for heavy oil which, on a housing block 12, comprises a tube portion 14 of an inside diameter d which in this case is 60 mm, the tube portion 14 being supported by means of a cast leg structure 16 on the burner brick 18 of a lining which for the sake of clarity of the drawing is not further illustrated therein; the tube portion 14 projects into an opening 19 in the burner brick 18, with the opening 19 increasing in a tapering configuration from the tube portion 14 in the direction of the flame.

Provided in the housing block 12 is an inlet 20 for heavy oil which opens into a valve chamber 22. Mounted in the valve chamber 22 is a ball-like valve member 23 which is urged by a spring 24 disposed at the inlet side, towards an annular valve seat; the valve seat surrounds one end of an outlet chamber 26 from which a bore 28 extends at a right angle, in the selected embodiment, constituting part of a burner passage 30 for the heavy oil. The bore 28 is connected to the interior 32 of an oil feed tube 33 of an outside diameter e, which forms a spray nozzle and which extends coaxially in the tube portion 14 forming a jacket tube; the tube 33 terminates within the tube portion 14 at a spacing h from the edge 15 of the mouth opening of the jacket tube or tube portion 14. The distance h by which the tube portion 14 projects beyond the tube 33, in the illustrated embodiment, is 150 mm, while the outside diameter e of the oil feed tube 33 is 16 mm.

Projecting into the outlet chamber 26 of the housing block 12 is a pushrod 36 which is guided in a bore 37 coaxial with respect to the inlet 20, and which is fixed at one end to a piston 38; surrounding the pushrod 36 is a spring 40 which is supported at one side against the piston 38 and on the other side against the end wall 42 of a pressure chamber 43 which accommodates the piston 38.

A feed conduit 44 for servo air opens into the pressure chamber 43; when that servo air acts on the piston 38, then, against the force of the spring 40, it moves the pushrod 36 and therewith the valve member 23 which bears closely against the free end of the pushrod, in the direction indicated by the arrow x. In that case, the valve member 23 leaves the valve seat 25 and opens the path for the heavy oil which is supplied at 20.

The heavy oil flows through the outlet chamber 26 and passes into the bore 28. Therein the amount of heavy oil to be burnt is determined by a metering regulator 46 which varies the bore cross-section. Opening into the bore 28 beneath the measuring regulator 46 which in this case is of a bar-like configuration is a supply passage 48 for primary burner air (arrow y) which is mixed with the heavy oil at the outlet of the bore.

The annular space 50 between the oil feed tube 33 and the jacket tube 14 surrounding same receives secondary air (arrow z) through lateral openings 51 in the tube portion 14. The secondary air flows around the edge 34 of the mouth opening of the oil feed tube 33 and prevents it from becoming encrusted.

The flame F which is produced at the oil feed tube 33 is usually of a length q of 1500 mm and is of a maximum width b of 150 mm.

What is claimed:

1. An atomizing burner for the combustion of heavy oil which comprises: a burner passage for the feed of liquid fuel to a firing chamber including a nozzle tube, said nozzle tube having a mouth opening; means for supplying heavy oil to said burner passage including means for discontinuing the oil flow; means for supplying a primary air flow to said burner passage downstream of the means for supplying heavy oil; a jacket tube surrounding said nozzle tube and projecting beyond the mouth opening of the nozzle tube, said jacket tube and nozzle tube forming two concentrically arranged tubes closed at one end and open at the other end and forming an annular space between the jacket tube and the nozzle tube; means for supplying secondary air to the annular space for supply to the heavy oil flow downstream of the primary air flow; and valve means upstream of the means for supplying primary air to regulate the oil flow wherein the nozzle tube and the jacket tube are connected at the closed end to a housing block and the housing block includes a valve chamber with a valve seat therein, said valve chamber being in fluid flow communication with the burner passage and located upstream thereof, a valve member and force storage means in the valve chamber wherein the valve member is movable against the force storage means, a piston spaced from the valve chamber and a pushrod connected to the piston and to the valve member, wherein the pushrod guides the valve member at a space relative to the valve seat by means of the pushrod.

2. An atomizing burner according to claim 1 wherein said piston carrying the pushrod is adapted to be acted on by compressed air.

* * * * *